US012038248B2

(12) United States Patent
Gidikov

(10) Patent No.: US 12,038,248 B2
(45) Date of Patent: Jul. 16, 2024

(54) SUPPRESSOR

(71) Applicant: BAMEKS—98 AD, Karlovo (BG)

(72) Inventor: Trifon Ganchev Gidikov, Karlovo (BG)

( * ) Notice: Subject to any disclaimer, the term of this patent is extended or adjusted under 35 U.S.C. 154(b) by 115 days.

(21) Appl. No.: 17/755,876

(22) PCT Filed: Dec. 23, 2019

(86) PCT No.: PCT/BG2019/000030
§ 371 (c)(1),
(2) Date: May 11, 2022

(87) PCT Pub. No.: WO2021/092663
PCT Pub. Date: May 20, 2021

(65) Prior Publication Data

US 2022/0381531 A1 Dec. 1, 2022

(30) Foreign Application Priority Data

Nov. 11, 2019 (BG) ..... 4571

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/325
USPC ..... 89/14.4
See application file for complete search history.

(56) References Cited

U.S. PATENT DOCUMENTS

| | | | | |
|---|---|---|---|---|
| 11,333,458 | B1 * | 5/2022 | Hunt | F41A 21/30 |
| 2013/0227871 | A1 | 9/2013 | Stone | |
| 2016/0010935 | A1 | 1/2016 | Clarke et al. | |
| 2018/0058791 | A1 | 3/2018 | Larue | |
| 2018/0274873 | A1 | 9/2018 | Thomas | |
| 2018/0306544 | A1 * | 10/2018 | White | F41A 21/30 |
| 2018/0347931 | A1 * | 12/2018 | Schoppman | F41A 21/36 |
| 2020/0284541 | A1 * | 9/2020 | Poling | F41A 21/30 |

FOREIGN PATENT DOCUMENTS

| | | |
|---|---|---|
| EP | 1255959 B1 | 8/2008 |
| SE | 535 605 C2 | 10/2012 |

OTHER PUBLICATIONS

ISR; European Patent Office; Netherlands; Jul. 24, 2020.

* cited by examiner

*Primary Examiner* — Bret Hayes
(74) *Attorney, Agent, or Firm* — Patshegen IP; Moshe Pinchas

(57) ABSTRACT

A rifled firearm suppressor, a.k.a. a silencer, to be mounted in the front section of the rifled firearm barrel. The suppressor includes a stem 4 including rear discharge chamber 11 and a front extension chamber 12; the two chambers 11 and 12 are separated from each other by a dividing groove 3. The suppressor further includes a removable connecting sleeve 16 coupled to the stem and configured to connect to the barrel of the firearm. Also, The suppressor further includes at least two outlet openings 10 symmetrically axially oriented with respect to the axis of the suppressor at the forehead of the front section of the discharge chamber 11.

5 Claims, 3 Drawing Sheets

SUPPRESSOR

FIELD OF THE INVENTION

The utility model is related to a rifled firearm suppressor, a.k.a. a silencer, to be mounted in the front section of the rifled firearm barrel and intended to reduce the harmful effects of the gases upon having the bullet exiting/leaving from the muzzle section, thus achieving reduction of noise and recoil when firing

BACKGROUND OF THE INVENTION

It is well known to anyone, even to a non-specialist in the field of firearms, that when even a single shot is fired, it produces much noise and recoil. These effects (noise and recoil) are caused by the high-pressure gases coming out of the gun barrel immediately after the bullet. Usually, when the firearm is triggered, burning of gunpowder charges in a metal casing delivers a compressive force that accelerates the movement of the bullet through the barrel. The active kinetic energy causes the bullet to move towards the target.

Release of gases from the charge burning is accompanied by a high level of noise and recoil. The magnitude of this noise is usually proportional to the speed and pressure of the gases. Regardless of the caliber of firearms, when used, they emit harmful noise levels when fired, resulting in permanent damage of hearing and the central nervous system.

In order to reduce noise and recoil at firing, it is necessary to reduce the pressure and speed of the gases exiting the firearm barrel after the bullet. Using the well-known relation pressure±volume, it is common to look for constructive solutions where high-pressure gas is expanded into a closed-volume casing, having one end fixed to the barrel of the firearm and the other end of the body is actually the suppressor part of the device where expansion is provided in a controlled manner, thereby simultaneously reducing the pressure level and the speed of the gases.

A wide variety of design/construction solutions is known in practical embodiments, aiming to slow down the speed of the gases at firing. These devices are designed for mounting on the barrel of the firearm, boasting a high degree of strength. Most of these devices usually consist of a housing where, by using different in shape and layout elements (barriers, openings and channels) the fired gases from the gunpowder charge are directed and pass through these elements.

The analysis of known patented technical solutions shows that, for the purpose of reducing the pressure of the gases, suitable combinations of structural elements such as internal partitions, channels, openings, and gratings are used to form interconnected work chambers (working volumes).

Studies of the known suppressors in the market show these structural elements have the effect of not only reducing the pressure, but also simultaneously reducing the temperature of the gases released at firing, thus achieving a favorable control of the flow of gases, i.e. it may be possible to create conditions to allow the release of the separated gases to be performed for a longer period of time through the axial orifice of the bullet passing.

The suppressor is mounted to the firearm by a threaded connection between a threaded. sector, made along the barrel of the firearm, and an internal. thread made in a fixedly mounted in a steel sleeve centrally located in the suppressor core, providing connection between the aforesaid elements.

The various design solutions are not widespread in order to allow the same product/article to be used on different types of connecting threads of firearm barrels.

A suppressor is known produced by Recknagel (Product catalog—March 2019), and it consists of a cylindrical metal housing, and its interior space houses a core with a disk-shaped partition system of elements and openings made along the outer surface on the core. A fixed connection sleeve is mounted inside the core, with a connecting thread made along its inside surface to attach the firearm barrel of the specified size. This noise silencer joins the barrel by a threaded coupling between the said sleeve and an outer thread formed along the barrel. When the bullet enters the casing of the suppressor, the disk partition system acts so that after passing through each subsequent partition, the gas pressure begins to decrease, thus creating conditions of controlling the speed of the gases after the bullet.

A disadvantage of the construction described is the fact the suppressor is of limited application due to the fact it can only be mounted on a specific thread size of a firearm barrel.

Patent Publication EP1255959 B1 is known and it describes a suppressor mounted on the barrel of the firearm by means of a threaded connection internally formed on the core of the suppressor. The device consists of an external casing where the core is located in, and radially shaped disk elements on it forming the working chambers. The core and disk elements are formed as a single body, with gas openings (as shown in FIG. 6) arranged radially along the core, located only in the working chambers in front of the muzzle cut. In the rear section of the core, a threaded sector expansion is formed to connect the core to the casing. Centrally, an internal thread is formed in the rear section of an orifice made in the core by which the suppressor is fixedly mounted to the barrel of the firearm. When firing, the released gases pass through the said gas openings formed along the core, whereby a portion of the released gases return back through the openings formed on the disk elements (as shown in FIG. 5), entering the suppressor chambers, located between two disk elements behind the muzzle cut, then return to the front section and exit the suppressor through its central opening.

A disadvantage of the known technical solution is the insufficiently effective action. The core with the disk elements and gas openings is structurally constructed in such a way that by having this positioning of the suppressor relative to the barrel of the firearm, while firing the operation chambers 1, 3, and 4 the main bulk of the released gases pass through are many times more loaded by the operation chambers 2 and 5, as the latter have a much smaller proportion of released gases, and it results in the following: the provided rear chambers (2 and 5) are not effective enough in regards to reducing the pressure of the gases.

SUMMARY OF THE INVENTION

Taking into consideration the aforesaid prior art of the technology in the revised field, the aim of the utility model is to offer a suppressor of an increased resource of use, to provide a significant reduction of noise and recoil by the fired gases, allowing high firing rate while maintaining efficiency as well as its use with ammunition of increased /magnum/ charge. Another aim of the utility model is to have the suppressor distinguished for its efficiency in regards to its versatile use in various sizes of firearm barrels.

The aim of the utility model is solved by a suppressor, consisting of a cylindrical casing, where a stem with radially disposed disk elements is arranged in, having a number of gas openings made along the stem, where the openings in a row are shifted in relation to the openings in another row, and an internal thread is made/placed inside the stem.

According to the utility model, the suppressor consists of a rear discharge (unloading) chamber, formed by rear and front extension along the stem, on which a fixed a rear casing (housing) is mounted and a front extension chamber, formed by the rear and front extension, to which a fixed front casing is mounted, wherein the discharge and extension chambers are separated from each other by a dividing channel, and in the rear discharge chamber, inside the stem there is a removable connecting sleeve attached to the firearm barrel, as externally along the stem, radially arranged gas openings are located whereby along the front extension of the discharge chamber, at least two outlet openings are symmetrically aligned axially to the axis of the suppressor, and in the rear extension of the discharge chamber, a threaded section is formed—and at least two openings are formed along it whereby the inside wall of the rear extension, a groove is formed with a slotted ring in it and at the front extension chamber of the suppressor have at least two disk elements.

According to a preferred embodiment of the suppressor, the outlets in the front extension of the discharge chamber are oriented at an acute angle to the axis of the stem.

The replaceable connecting sleeve is made with an internal thread corresponding to the thread of the respective barrel, and two thread sections are formed along its outer surface, separated by a locking channel.

According to a preferred embodiment of the core, a fixing orifice is formed on its outer surface, the location of which coincides with the fixing groove of the replaceable connecting sleeve.

According to a preferred embodiment of the stem, at least two fixing orifices oriented at 900 toward each other are formed on its outer surface, the location of which coincides with the fixing groove of the replaceable connecting sleeve.

In the rear section of the stem an extension is formed whose size corresponds to the size of the suppressor casing, wherein a groove with a slotted ring in it is formed in the inner diameter of the extension.

Preferably, the slotted ring is made of Teflon.

According to the utility model, the suppressor is characterized by a simple and technically and technologically efficient construction. The proposed suppressor allows the same product to be used in firearms of different barrel diameters and connecting thread sizes. This is achieved thanks to a properly shaped replaceable sleeve, guaranteed to be fixed to the stem of the suppressor, and it can be carried out easily and quickly; no special qualification is required for the mounting (installation) and disassembly works on the sleeve replacement.

The improved efficiency of the noise silencer is expressed mainly due to the rapid release of a large part of the gases discharged during firing—it is carried out through the outlets formed at the forehead of the front expansion of the rear discharge chamber, when gases are released directly into the atmosphere before the bullet leaves the suppressor. The accelerated discharge of part of the gases through the discharge openings of the discharge chamber extends the life of the suppressor and allows its use at high firing rates without compromising the effectiveness of the suppressor in reducing noise and recoil of the firearm.

Another advantage of the proposed suppressor is the following: gases of highly reduced pressure pass through the suppressor's front expansion chamber, and it practically permits effective noise suppression, while dramatically reducing the load on the disk elements and the casing—resulting from the reduced pressure of the passing gases.

BRIEF DESCRIPTION OF THE DRAWINGS

According to the utility model, an exemplary embodiment of the suppressor is presented in more details using the accompanying drawings, where.

PRIMARY EMBODIMENT OF THE INVENTION

Figure 1:
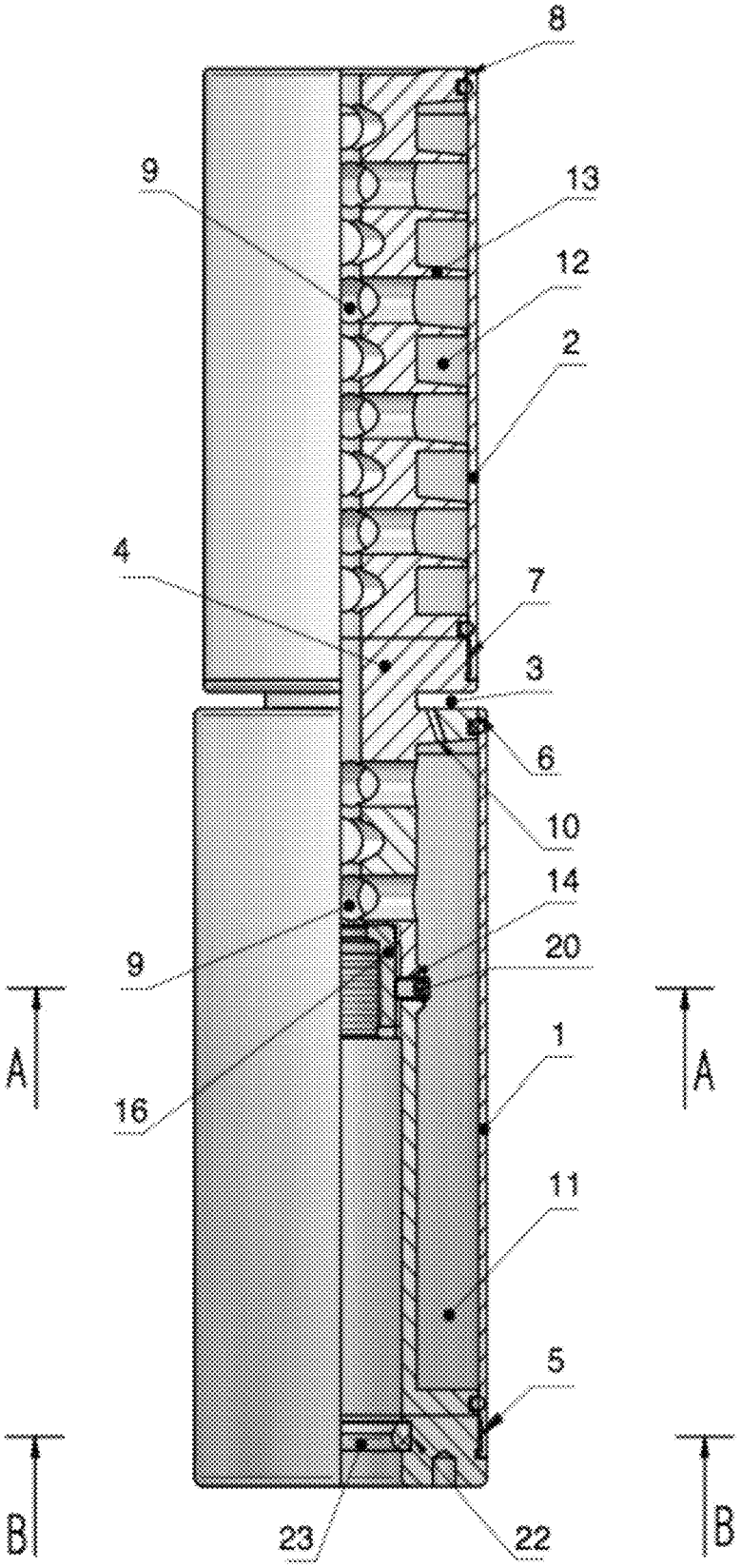
FIG. 1A general view of the suppressor according to the utility model, with a half-section of the stem and the replaceable sleeve FIG. 2A cross-sectional view of the suppressor of A-A from FIG. 1
Figure 2:
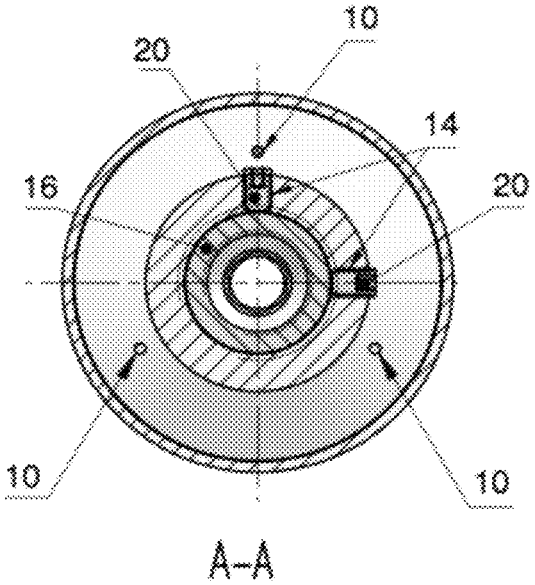
Figure 3:
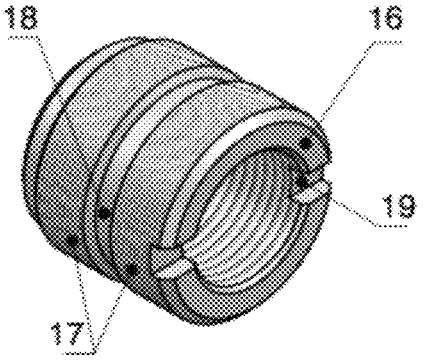
FIG. 3 An axonometric view of a removable connection sleeve according to the utility model FIG. 4A cross-sectional view along the B-B from FIG. 1
Figure 4:
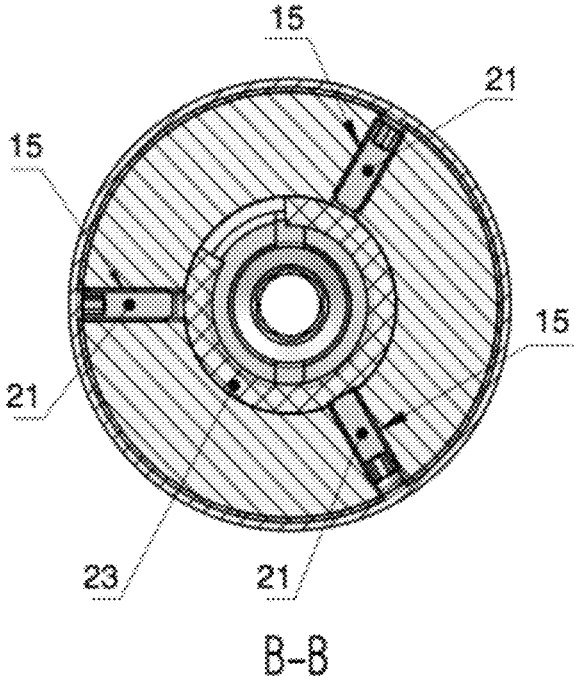
Figure 5:
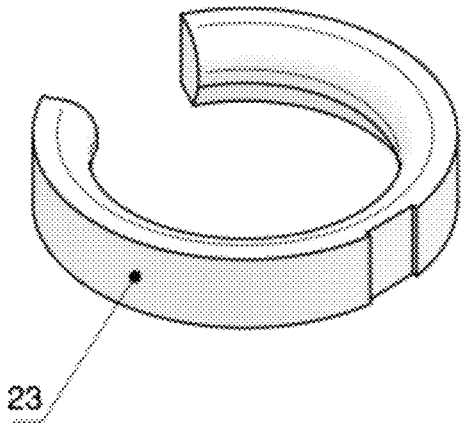
FIG. 5 An axonornetric view of a slotted ring located in the channel of the extension of the rear extension of the discharge chamber.

The description further provides an exemplary embodiment of a suppressor according to the utility model, characterized by a technological construction providing improved noise reduction functionalities when using a firearm, and an exemplary embodiment is provided suitable for use with hunting weapons and it does not restrict their use in other firearms, as well as the use of barriers and openings adapted in regards to their placement and design, in a way that provides an equivalent effect in suppressing noise accompanying the movement of gases when discharged from the barrel of a firearm.

The present utility model can be understood in more details by reference to the accompanying drawings, description, examples and claims. The above should not be construed as limiting to the exemplary embodiment described, with its specific constructive elements, insofar as variations of the embodiment can be made, retaining the idea of universal use of the suppressor in various firearms by fast and easily changing the connecting sleeve.

According to the utility model, the suppressor consists of a front casing 2, respectively a rear casing 1, separated by a dividing groove 3. Along the two casings 1 and 2, a stem 4 is located inside, and each of the said casings 1 and 2 is secured to the stem 4 by expansions (5 and 6, located at both ends of the rear discharge chamber 11 and extensions 7 and 8 located at both ends of the front extension chamber 12 formed in the volume of the suppressor closed between the casings 1 and 2, the stem 4 and their closing extensions 5, 6, 7 and 8.

The front section of the discharge chamber 11 includes the rear section of the stem 4, wherein a removable connecting sleeve 16 is mounted in the inner opening of the stem 4. The sleeve 16 is made with an internal thread corresponding to the barrel thread of the firearm. Along the outer surface of the sleeve 16, two threaded sections 17, separated by a groove 18, are made. Along the outer surface of the stem 4 a threaded opening 14 is formed and it is adapted for winding of fixing elements, such as locking screws 20. According to a preferred embodiment, the threaded openings are at least two and are oriented at $_{90}$° towards each other, and their location coincides with the fixing groove 18 of the removable connecting sleeve 16. In the forefront, in the rear section of the removable sleeve 16, a mounting groove 19 is fitted.

In the area of the stem 4, after the point of connection of the suppressor to the firearm barrel, gas outlets 9 are formed shifted to each other. At the front extension 6 of the discharge chamber 11, at least two discharge (injection) openings 10 are formed. According to a preferred embodiment of the discharge chamber 11, three discharge outlets 10 of a diameter of 0.5 to 5 mm are located and arranged symmetrically along the diameter of the expansion (6).

The effectiveness of the direct discharge of gases through the openings 10 is greatly improved when the said injection openings (10) are oriented at an angle of 20° to 80° degrees with respect to the central axis of the suppressor, preferably at an angle of 60° degrees.

The extension chamber 12 includes a system of consequently located disk elements 13 along the stem 4 and the gas outlets 9.

A groove 22 is formed along the inner diameter of the extension 5, oriented against the threaded openings 15, and a slotted ring 23 is located in it. Locking screws 21 are wound in the threaded openings 15.

The suppressor is mounted and used as follows: Unwind the casing 1, as it provides access to the elements of the unloading chamber 11. Wind the replaceable connecting sleeve 16 to the stem 4 until it stops, and then the sleeve 16 is fixed to the stem 4 by tightening the fixing screws 20. The stem 4 is wound on the barrel of the firearm and the screws 21 are wound one after another so that the slotted ring 23 rests on the barrel. The casing 1 is then wound to a full stop at the threads of the extensions 5, and the suppressor is ready for use.

When firing, after a bullet leaves the barrel, the gases discharged therefrom pass through the gas openings 9, whereby a portion of these gases is released through the outlet openings 10 directly into the atmosphere.

The remaining gases enter the extension chamber 12 under severely reduced pressure, passing through the gas outlets/vents 9 in between the disk elements 13, and are then released into the atmosphere through the central opening of the suppressor.

If necessary, the suppressor may be used on another weapon of a different connecting thread and/or outer diameter of the barrel, and the mounting operations described above are carried out in reverse order; the connecting sleeve 16 is dismounted from its fixed position by unscrewing the fixing screws 20, and then the mounting groove 19 is unscrewed, taken out and another attachment connecting sleeve—whose internal thread corresponds to the outer thread on the barrel of the firearm—is mounted.

The description should also be understood in such a way that the terminology used herein is solely for the purpose of describing specific aspects of the description and cannot be limiting in this respect. The described exemplary embodiment allows for the best currently preferred embodiment.

Specialists in the reviewed technical field will recognize and appreciate various design changes can be made similar to those described herein while still benefiting from the level of noise reduction produced by the gases released by the explosive after firing.

LEGEND:

1) Casing discharge chamber
2) Casing extension chamber
3) Groove
4) Stem
5) Extension in the rear section of the core
6) Extension in the front section of the discharge chamber
7) Extension in the rear section of the extension chamber
8) Extension in the front section of the extension chamber
9) Gas openings
10) Injection opening
11) Rear chamber
12) Front chamber
13) Disk
14) Threaded opening against the fixing sleeve groove
15) Threaded opening against a groove of a slotted ring
16) Replaceable connecting sleeve
17) Threaded sectors on bushing 16
18) Fixing groove between threaded sectors
19) Mounting groove
20) Locking screw for a threaded sleeve
21) Locking screw for a slotted ring
22) Groove for a slotted ring
23) Slotted ring

The invention claimed is:

1. A suppressor comprising:

a cylindrical casing, including a front casing (2) and a rear casing (1);

a stem (4) inside said cylindrical casing, said stem (4) includes a rear discharge chamber (11) secured to said rear casing (1) by rear and front extensions (5 and 6) and a front extension chamber (12) secured to said front casing (2) by rear and front extensions (7 and 8), wherein the discharge and the extension chambers (11 and 12) are separated from each other by a dividing groove (3), wherein said stem (4) includes a number of gas openings arranged in rows;

a removable connecting sleeve (16) housed inside the stem (4) and configured to be connected to a barrel of a firearm;

at least two outlets (10) symmetrically arranged at a forehead of the front extension (6) of the discharge chamber (11), axially to an axis of the suppressor, while in the rear extension (5) of the discharge chamber (11) there is a threaded section made with at least two openings (15);

wherein an internal wall of the rear extension (5) includes a groove (22) and a slotted ring (23) is located inside the rear extension (5), and wherein the front extension chamber (12) includes at least two disk elements (13).

2. The suppressor according to claim 1, wherein the at least two outlet (10) are oriented at an acute angle to a longitudinal axis of the stem (4).

3. The suppressor according to claim 1, wherein the removable connecting sleeve (16) is made with an internal thread corresponding to a thread of the barrel, and two threaded sections (17) separated by a fixing groove (18) are formed on an outer surface of the removable connecting sleeve (16).

4. The suppressor according to claim 3, wherein the stem (4) includes at least one threaded opening (14) formed on an outer surface thereof, and a location of the at least one threaded opening (14) coincides with the fixing groove (18) of the removable connecting sleeve (16).

5. The suppressor according to claim 3, wherein the stem (4) includes at least two threaded openings (14) formed on an outer surface thereof; said at least two threaded openings are oriented at 90° relative to each other, and their arrangement corresponds to the fixing groove (18) of the removable connecting sleeve (16).

* * * * *